US008552794B2

(12) United States Patent
Hirobe et al.

(10) Patent No.: US 8,552,794 B2
(45) Date of Patent: Oct. 8, 2013

(54) CONSTANT-VOLTAGE CIRCUIT

(75) Inventors: Kisei Hirobe, Miyagi-ken (JP); Junichi Saito, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 30 days.

(21) Appl. No.: 13/353,213

(22) Filed: Jan. 18, 2012

(65) Prior Publication Data

US 2012/0200343 A1 Aug. 9, 2012

(30) Foreign Application Priority Data

Feb. 8, 2011 (JP) ..... 2011-024971

(51) Int. Cl.
*G05F 1/10* (2006.01)
*G05F 3/02* (2006.01)

(52) U.S. Cl.
USPC ..... 327/541; 327/539

(58) Field of Classification Search
USPC ..... 327/538–541, 543; 323/316
See application file for complete search history.

(56) References Cited

U.S. PATENT DOCUMENTS 6,201,437 B1 * 3/2001 Kono et al. ..... 327/545
6,617,835 B2 * 9/2003 Nishimura ..... 323/313
6,867,641 B2 * 3/2005 Kang et al. ..... 327/541
7,034,514 B2 * 4/2006 Tachibana et al. ..... 323/313
7,205,682 B2 * 4/2007 Kuramori ..... 307/80
7,348,834 B2 * 3/2008 Itoh ..... 327/539
2003/0211870 A1 * 11/2003 Jiguet et al. ..... 455/574
2009/0167663 A1 * 7/2009 Ker et al. ..... 345/92
2010/0045367 A1 2/2010 Hasegawa et al.

FOREIGN PATENT DOCUMENTS

JP 2010-49422 3/2010
JP 2010-108419 5/2010

* cited by examiner

*Primary Examiner* — Quan Tra
(74) *Attorney, Agent, or Firm* — Beyer Law Group LLP

(57) ABSTRACT

A constant-voltage circuit includes a first reference voltage generation unit which generates a reference voltage using a bandgap voltage of a bipolar transistor, a second reference voltage generation unit which generates a reference voltage using a field effect transistor, a constant voltage generation unit which generates a constant voltage with reference to either an output voltage of the first reference voltage generation unit or an output voltage of the second reference voltage generation unit, and a control unit which controls the first reference voltage generation unit, the second reference voltage generation unit, and the constant voltage generation unit. During an initial activation period, the first reference voltage generation unit and the second reference voltage generation unit are operated, and during a subsequent operation period, the first reference voltage generation unit is stopped.

8 Claims, 6 Drawing Sheets

4
C3
409
427
429
425
PS_1N
423
426
SEL_N
406
408
SEL_N
405
PS_1N
404
415
416
419
420
421
422
PS_N
403
418
PS
413
414
402
SEL
428
401
SEL_N
411
412
417
430
424
407
410
SEL
A3
Vdd
C1
VREF1
SEL
SEL_N
C2
VREF2
B3
Vss

CONSTANT-VOLTAGE CIRCUIT

CLAIM OF PRIORITY

This application claims benefit of Japanese Patent Application No. 2011-024971 filed on Feb. 8, 2011, which is hereby incorporated by reference.

BACKGROUND OF THE INVENTION

1. Field of the Invention

The present invention relates to a constant-voltage circuit which generates a stable voltage.

2. Description of the Related Art

A reference voltage generation circuit using a bipolar transistor or a reference voltage generation circuit using a field effect transistor has hitherto been known (for example, see Japanese Unexamined Patent Application Publication Nos. 2010-49422 and 2010-108419). In general, a reference voltage generation circuit using a bipolar transistor has a feature of stable activation with a constant voltage and little influence of a process variation. A reference voltage generation circuit using a field effect transistor has a feature of low power consumption.

From the features of the reference voltage generation circuits, in a digital circuit which needs to rapidly generate a constant voltage, a constant-voltage circuit which includes a reference voltage generation circuit using a bipolar transistor is frequently used. However, since the reference voltage generation circuit includes the bipolar transistor which is driven by a base current, there is a problem in that power consumption of the constant-voltage circuit increases. In order to suppress power consumption, if a reference voltage generation circuit using a field effect transistor is used, it is difficult to activate the reference voltage generation circuit with a stable voltage. As described above, in the constant-voltage circuit of the related art, it is difficult to achieve both activation with a stable voltage and low power consumption.

SUMMARY OF THE INVENTION

The invention provides a constant-voltage circuit which achieves both stable actuation and low power consumption.

A constant-voltage circuit of the invention includes a first reference voltage generation unit which generates a reference voltage using a bandgap voltage of a bipolar transistor, a second reference voltage generation unit which generates a reference voltage using a field effect transistor, a constant voltage generation unit which generates a constant voltage with reference to either an output voltage of the first reference voltage generation unit or an output voltage of the second reference voltage generation unit, and a control unit which controls the first reference voltage generation unit, the second reference voltage generation unit, and the constant voltage generation unit. During an initial activation period, the first reference voltage generation unit and the second reference voltage generation unit are operated, and during a subsequent operation period, the first reference voltage generation unit is stopped.

With this configuration, the constant-voltage circuit is launched by the first reference voltage generation unit using the bipolar transistor having excellent constant-voltage activation performance, and thereafter, the first reference voltage generation unit is stopped, thereby generating a constant voltage by the second reference voltage generation unit using the field effect transistor with low power consumption. Therefore, it is possible to realize a constant-voltage circuit which achieves both stable activation and low power consumption.

In the constant-voltage circuit of the invention, the control unit may have a storage unit which stores a correction value for use in correcting the output voltage of the second reference voltage generation unit. During the initial activation period, the control unit may be activated using an output voltage of the constant voltage generation unit generated with reference to the output voltage of the first reference voltage generation unit, and the control unit may read the correction value stored in the storage unit to correct the output voltage of the second reference voltage generation unit. During the subsequent operation period, the constant voltage generation unit may generate the output voltage with reference to the output voltage of the second reference voltage generation unit and may stop the first reference voltage generation unit.

With this configuration, it is possible to suppress the influence of a process variation in the second reference voltage generation unit without using a method, such as laser trimming or fuse trimming, thereby suppressing manufacturing cost of a constant-voltage circuit.

The constant-voltage circuit of the invention may further include an external voltage input terminal to which a reference voltage is applied, a switch which selects a voltage to be applied to the control unit from the output voltage of the constant voltage generation unit and the reference voltage, and a monitor pin which is configured to monitor the output voltage of the constant voltage generation unit. The correction value may be determined such that the output voltage of the constant voltage generation unit when the reference voltage is applied to the control unit has a predetermined value.

In the constant-voltage circuit of the invention, the storage unit may be rewritable.

In the constant-voltage circuit of the invention, the second reference voltage generation unit may include two field effect transistors which are diode-connected, and may be configured such that the influence of a fluctuation in the characteristic of one field effect transistor due to a change in temperature is balanceable by another field effect transistor.

In the constant-voltage circuit of the invention, the second reference voltage generation unit may include two field effect transistors whose gates are connected together, a first capacitor whose one end is connected to the gates, and a second capacitor whose one end is connected to another end of the first capacitor. A predetermined voltage may be applied to another end of the second capacitor such that a rapid fluctuation in the voltage of the gates is suppressed.

According to the invention, it is possible to provide a constant-voltage circuit which achieves both stable activation and low power consumption.

DESCRIPTION OF THE PREFERRED EMBODIMENTS

Hereinafter, the configuration of a constant-voltage circuit according to an embodiment of the invention will be described with reference to the drawings.

Figure 1:
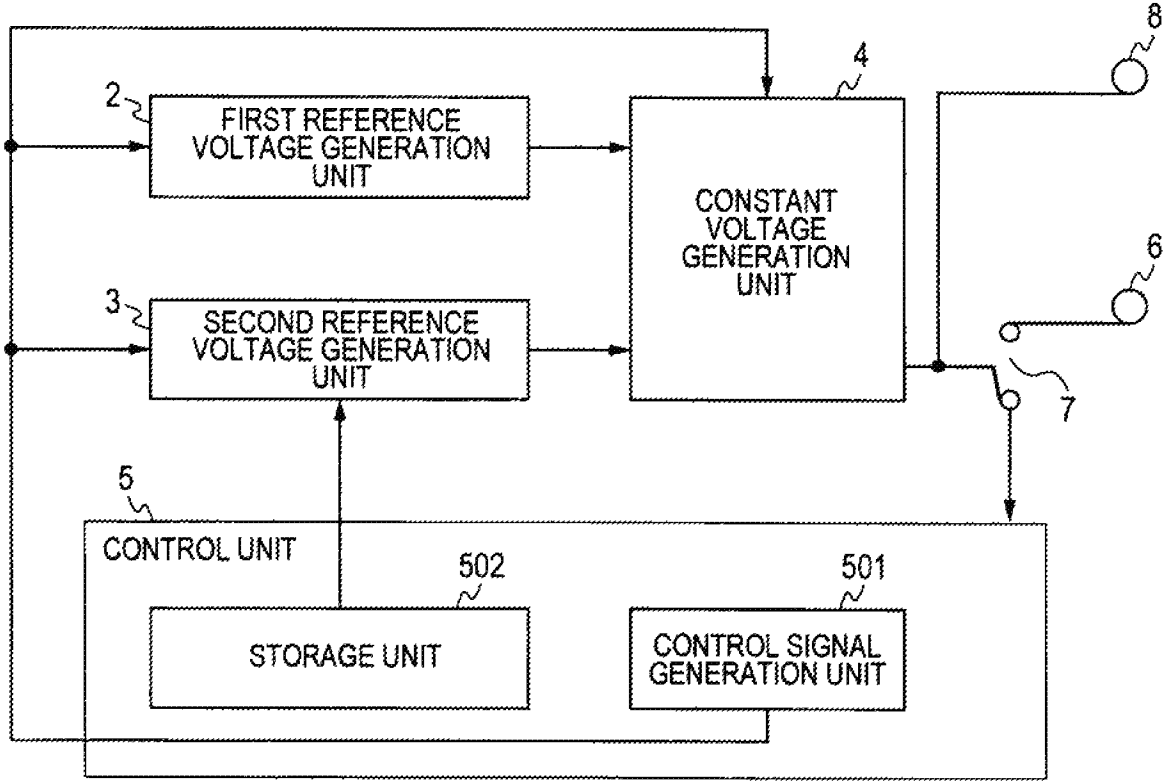
FIG. 1 is a block diagram showing a configuration example of a constant-voltage circuit according to this embodiment.

FIG. 1 is a block diagram showing a configuration example of a constant-voltage circuit 1 according to an embodiment of the invention. The constant-voltage circuit 1 of this embodiment has a first reference voltage generation unit 2 using a bipolar transistor, a second reference voltage generation unit 3 using a field effect transistor, a constant voltage generation unit 4 which generates a constant voltage with reference to an output voltage of the first reference voltage generation unit 2 or an output voltage of the second reference voltage generation unit 3, and a control unit 5 which controls the first reference voltage generation unit 2, the second reference voltage generation unit 3, and the constant voltage generation unit 4. The constant-voltage circuit 1 has an external voltage output terminal 6 to which a reference voltage from the outside is applied when determining a correction value of the second reference voltage generation unit 3, a switch 7 which is configured to apply the reference voltage to the control unit 5 when determining the correction value, and a monitor pin 8 which is configured to monitor the output voltage of the constant voltage generation unit 4 when determining the correction value.

Figure 2:
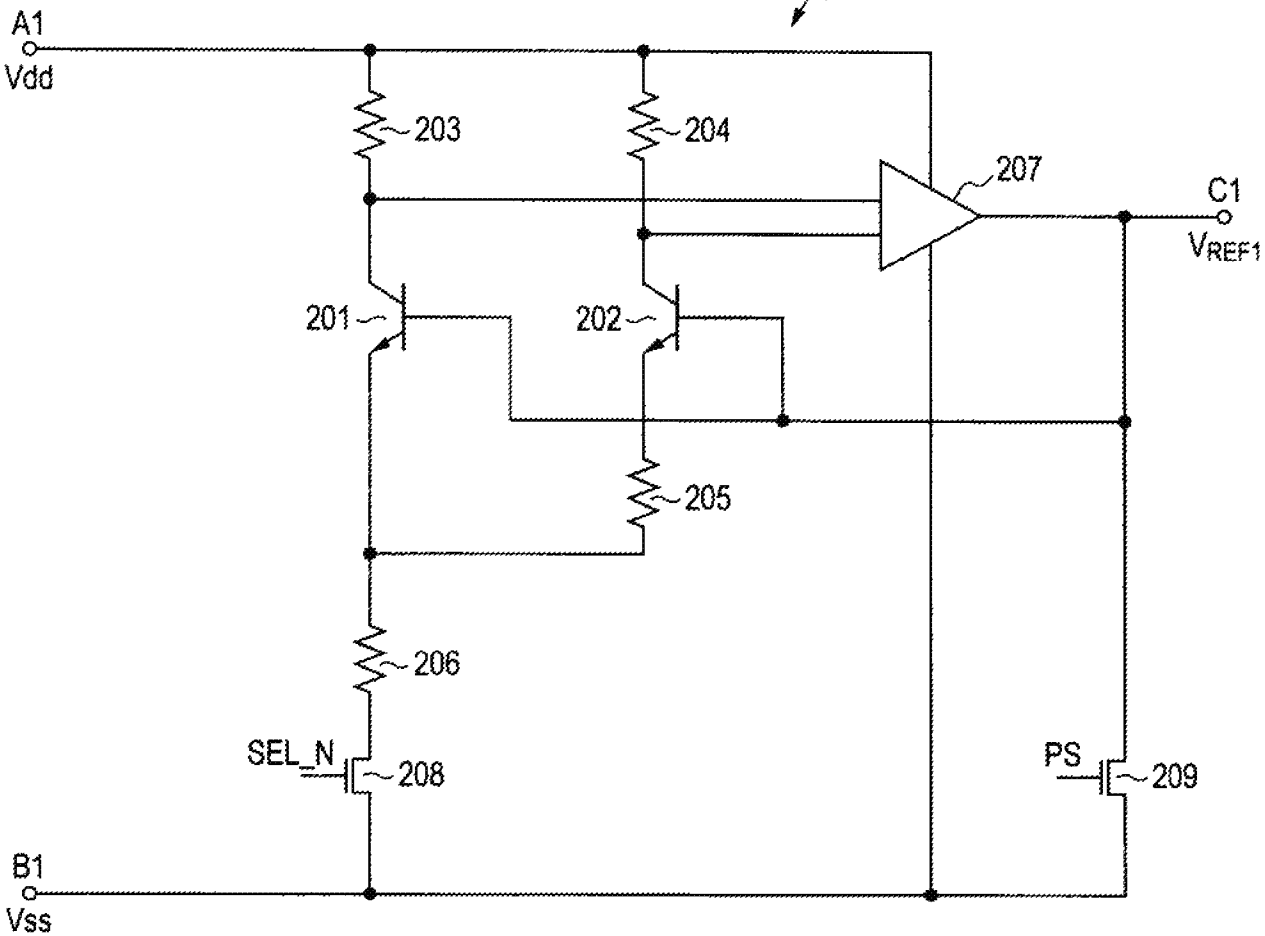
FIG. 2 is a circuit diagram showing a configuration example of a first reference voltage generation unit using a bipolar transistor according to this embodiment.

FIG. 2 is a circuit diagram showing a configuration example of the first reference voltage generation unit 2 in the constant-voltage circuit 1. The first reference voltage generation unit 2 is configured to generate a first reference voltage VREF1 on the basis of a bandgap voltage of a bipolar transistor. The first reference voltage generation unit 2 includes NPN-type bipolar transistors (hereinafter, referred to as NPN-type BJT) 201 and 202, resistors 203 to 206, an operational amplifier 207, and N-channel field effect transistors (hereinafter, referred to as N-type FET) 208 and 209. The NPN-type BJT 202 corresponds to eight NPN-type BJTs connected in parallel. In the first reference voltage generation unit 2, the NPN-type BJT 202 having eight NPN-type BJTs arranged in parallel with the NPN-type BJT 201 is disposed, such that a difference in VBE between two transistors is generated. An input voltage of the operational amplifier 207 is virtually shorted and becomes equal. Thus, a voltage corresponding to the difference in VBE is applied to a resistor 205 and a current flows, such that an output voltage is maintained at a first reference voltage VREF1 corresponding to the bandgap voltage. When the NPN-type BJT is made of silicon, the first reference voltage VREF1 is about 1.2 V.

The NPN-type BJT 201 is connected between a terminal A1 to which a power supply voltage Vdd is applied and a terminal B1 to which a ground voltage Vss (GND) is applied through resistors 203, 206, and the like. The NPN-type BJT 202 is connected between the terminal A1 and the terminal B1 through resistors 204, 205, 206, and the like. The collector of the NPN-type BJT 201 and the collector of the NPN-type BJT 202 are respectively connected to two input terminals of the operational amplifier 207, such that a voltage corresponding to the difference between a collector voltage of the NPN-type BJT 201 and a collector voltage of the NPN-type BJT 202 is output from the output terminal of the operational amplifier 207. The output terminal of the operational amplifier 207 is connected to an output terminal C1 of the first reference voltage generation unit 2 and is also connected to the base of the NPN-type BJT 201 and the base of the NPN-type BJT 202, such that the voltage of the output terminal C1 connected to the output terminal of the operational amplifier 207 is maintained at the substantially constant first reference voltage VREF1.

The N-type FET 208 is connected in series to the NPN-type BJTs 201 and 202, and is configured to control a current flowing between the terminals A1 and B1 by an inverted selection signal SEL_N (a signal obtained by inverting a selection signal SEL) from the control unit 5 to be applied to the gate thereof. When the inverted selection signal SEL_N is at a high voltage (hereinafter, referred to as high level), the N-type FET 208 is turned on and currents flows in the NPN-type BJTs 201 and 202. In this case, the first reference voltage generation unit 2 is enabled. When the inverted selection signal SEL_N is at a low voltage (hereinafter, referred to as low level), the N-type FET 208 is turned off, and no current flows in the NPN-type BJTs 201 and 202. In this case, the first reference voltage generation unit 2 is disabled. The inverted selection signal SEL_N is generated in the control unit 5 so as to be at high level during an initial activation period in which the first reference voltage generation unit 2 is operated and to be at low level during an operation period in which the first reference voltage generation unit 2 may not be operated. Thus, it is possible to stop the first reference voltage generation unit 2 during a period in which the first reference voltage generation unit 2 may not be operated. Therefore, it is possible to suppress power consumption by the first reference voltage generation unit 2.

The N-type FET 209 is controlled by a power save signal PS from the control unit 5. When the power save signal PS is at high level, the N-type FET 209 is turned on, and the voltage of the output terminal of the operational amplifier 207 falls down to the ground voltage Vss. The power save signal PS is at low level at the time of the operation of the constant-voltage circuit 1, such that the output terminal of the operational amplifier 207 is separated from the ground voltage Vss at the time of the operation of the constant-voltage circuit 1.

If the inverted selection signal SEL_N at high level and the power save signal PS at low level are input to the above-described first reference voltage generation unit 2 (the activation of the constant-voltage circuit 1), the N-type FET 208 is turned on, and the N-type FET 209 is turned off. When this happens, currents flow in the NPN-type BJTs 201 and 202, and voltages corresponding to the collector voltages of the NPN-type BJTs 201 and 202 are input to the two input terminals of the operational amplifier 207. As a result, the operational amplifier 207 outputs a voltage corresponding to the difference between the collector voltages of the NPN-type BJTs 201 and 202. Since the resistors 203 to 206 are connected to the NPN-type BJTs 201 and 202, the collector voltages of the NPN-type BJTs 201 and 202 fluctuate with the current flowing in the NPN-type BJTs 201 and 202. The currents flowing in the NPN-type BJTs 201 and 202 depend on the base voltages of the NPN-type BJTs 201 and 202. Since the output terminal of the operational amplifier 207 is connected to the bases of the NPN-type BJTs 201 and 202, the voltage of the output terminal of the operational amplifier 207 is maintained at a predetermined level (first reference voltage VREF1). Thereafter, if the inverted selection signal SEL_N is at low level, the N-type FET 208 is turned off, and the first reference voltage generation unit 2 is stopped.

Figure 3:
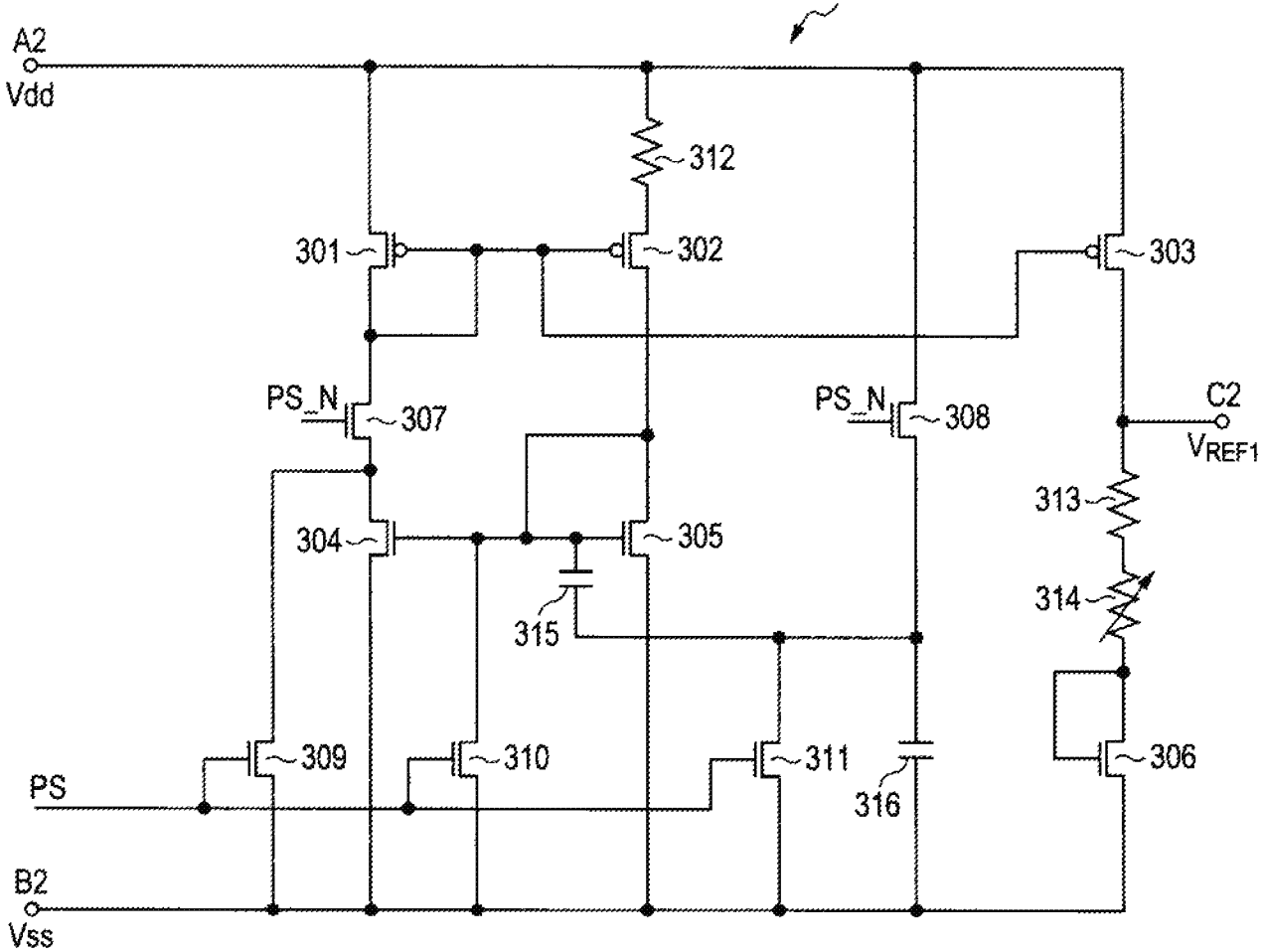
FIG. 3 is a circuit diagram showing a configuration example of a second reference voltage generation unit using a field effect transistor according to this embodiment.

FIG. 3 is a circuit diagram showing a configuration example of the second reference voltage generation unit 3 in the constant-voltage circuit 1. The second reference voltage generation unit 3 is configured to generate a second reference voltage VREF2 by a plurality of FETS. The second reference voltage generation unit 3 includes p-channel field effect transistors (hereinafter, referred to as P-type FET) 301 to 303, N-type FETs 304 to 311, resistors 312 and 313, a variable resistor 314, and capacitors 315 and 316. The second reference voltage generation unit 3 performs control such that a current flowing in the P-type FET 303 is substantially constant to maintain a drain voltage of the P-type FET 303 as an output voltage to be substantially constant.

The P-type FET 303 is connected between a terminal A2 to which the power supply voltage Vdd is applied and a terminal B2 to which the ground voltage Vss (GND) is applied. For this reason, if the P-type FET 303 is turned on, a current flows in the P-type FET 303 in a direction from the terminal A2 to the terminal B2.

The drain of the P-type FET 303 is connected to an output terminal C2 of the second reference voltage generation unit 3 such that a drain voltage becomes an output voltage of the second reference voltage generation unit 3. The drain of the P-type FET 303 is connected to the terminal B2 through the resistor 313, the variable resistor 314, and the diode-connected N-type FET 306, such that the drain voltage of the P-type FET 303, that is, the output voltage of the output terminal C2 can be controlled by the resistance values of the resistor 313, the variable resistor 314, and the diode-connected N-type FET 306 and the gate voltage of the P-type FET 303. The resistance value of the variable resistor 314 is determined in accordance with a correction signal from the control unit 5 so as to correct a variation in the output voltage of the second reference voltage generation unit 3 due to a process variation. Therefore, it is possible to correct the influence of a process variation or the like without using a method, such as laser trimming or fuse trimming, thereby providing the constant-voltage circuit 1 capable of generating the stable second reference voltage VREF2 with low cost.

The gate of the P-type FET 303 and the gates of the P-type FETs 301 and 302 are connected together, and the voltages thereof become equal. The P-type FET 301 is connected between the terminal A2 and the terminal B2. The P-type FET 301 is connected to the terminal B2 through the N-type FETs 304 and 307. For this reason, the P-type FET 301 and the N-type FETs 304 and 307 are turned on, such that a current flows in the P-type FET 301 and the N-type FETs 304 and 307 in a direction from the terminal A2 to the terminal B2. The P-type FET 302 is connected between the terminal A2 and the terminal B2. The P-type FET 302 is connected to the terminal A2 through the resistor 312, and is also connected to the terminal B2 through the N-type FET 305. For this reason, the P-type FET 302 and the N-type FET 305 are turned on, such that a current based on the resistance value of the resistor 312 flows in the P-type FET 302 and the N-type FET 305 in a direction from the terminal A2 to the terminal B2. It is assumed that the resistor 312 has a plurality of resistors having different temperature characteristics incorporated therein. It is possible to reduce temperature dependency by the resistor 312 having a plurality of resistors with different temperature characteristics incorporated therein, thereby generating the stable second reference voltage VREF2.

The P-type FET 301 is diode-connected, and the drain voltage and the gate voltage thereof become equal. Since the gates of the P-type FETs 301 to 303 are connected together, the gate voltages of the P-type FETs 301 to 303 become equal to the drain voltage of the P-type FET 301. Similarly, the N-type FET 305 is diode-connected, and the drain voltage and the gate voltage thereof become equal. The gates of the N-type FETs 304 and 305 are connected together, and the voltages thereof become equal. That is, the gate voltages of the N-type FETs 304 and 305 become equal to the drain voltage of the N-type FET 305.

Figure 4:
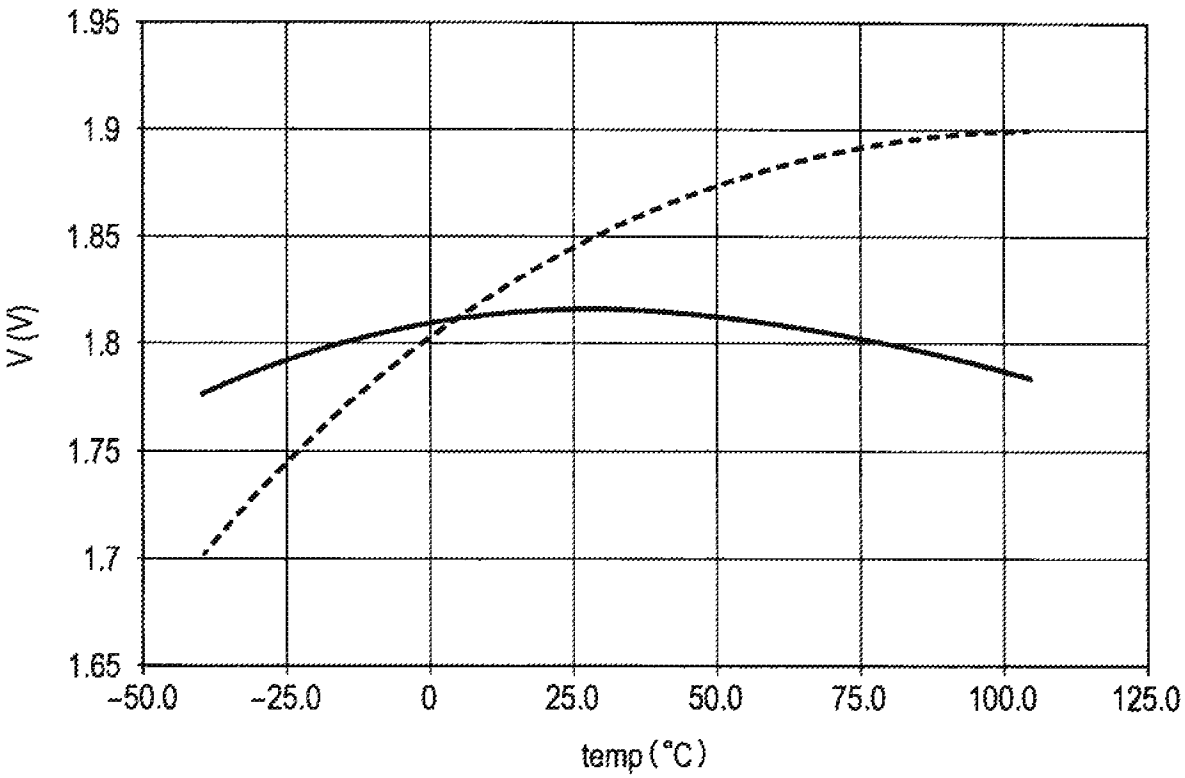
FIG. 4 is a graph showing the relationship between an output voltage of the second reference voltage generation unit according to this embodiment and temperature.

As described above, the N-type FET 305 and the N-type FET 306 are both diode-connected. It is assumed that the N-type FET 305 and the N-type FET 306 are manufactured by the same process. For this reason, the N-type FET 305 and the N-type FET 306 have the equivalent characteristics. With the N-type FET 306, it becomes possible to balance the influence of a fluctuation in the characteristic of the N-type FET 305 due to a change in temperature, thereby suppressing a temperature variation in the output voltage of the second reference voltage generation unit 3. That is, it is possible to generate the stable second reference voltage VREF2. FIG. 4 is a graph showing the relationship between the output voltage (V: vertical axis) of the second reference voltage generation unit 3 and temperature (° C.: horizontal axis). A solid line indicates the output voltage of the second reference voltage generation unit 3, and a broken line indicates the output voltage of a reference voltage generation unit which uses a fixed resistor, instead of the N-type FET 306. From FIG. 4, it can be seen that the output voltage of the second reference voltage generation unit 3 of this embodiment is stable in a wide temperature range.

The gates of the N-type FETs 304 and 305 are connected to the terminal A2 through the capacitor 315 and the N-type FET 308 which is controlled by an inverted power save signal PS_N (a signal obtained by inverting the power save signal PS). The source of the N-type FET 308 and one end of the capacitor 315 are connected to the terminal B2 through the capacitor 316. In this way, the capacitor 315 and the N-type FET 308 which apply the power supply voltage Vdd are connected to the gates of the N-type FETs 304 and 305, and the capacitor 315 is connected to the capacitor 316, such that the gage voltages of the N-type FETs 304 and 305 are stabilized.

For example, when the above-described configuration is not provided, if the power supply voltage Vdd falls rapidly, the gate voltages of the N-type FETs 304 and 305 also fall, and the generation of the reference voltage is stopped. However, in the second reference voltage generation unit 3 having the above-described configuration, if the power supply voltage rapidly falls, the inverted power save signal PS_N is at low level in connection with the power supply voltage, and the N-type FET 308 is turned off. For this reason, there are no significant fluctuations in the gate voltages of the N-type FETs 304 and 305. This is because the N-type FET 308 is controlled by the inverted power save signal PS_N and functions as a diode. Therefore, it is possible to prevent operation failure of the second reference voltage generation unit 3 due to a rapid fluctuation in the power supply voltage, thereby generating the stable second reference voltage VREF2.

The N-type FETs 309 to 311 are controlled by the power save signal PS from the control unit 5. When the power save signal PS is at high level, the N-type FETs 309 to 311 are turned on, and a voltage on a node to which the drains of the N-type FETs 309 to 311 are connected falls down to the ground voltage Vss. At the time of the operation of the constant-voltage circuit 1, since the power save signal PS is at low level, the N-type FETs 309 to 311 are turned off.

If the power save signal PS at low level and the inverted power save signal PS_N at high level are input to the above-described second reference voltage generation unit 3 (the activation of the constant-voltage circuit 1), the N-type FETs 307 and 308 which are controlled by the inverted power save signal PS_N are turned on. When this happens, the high level is applied to the gates of the N-type FETs 304 and 305 through the N-type FET 308 and the capacitor 315, and the N-type FETs 304 and 305 are turned on. If the N-type FETs 304 and 305 are turned on, since the low level is applied to the drain of the P-type FET 301, the low level is also applied to the gates of the P-type FETs 301 to 303, and the P-type FETs 301 to 303 are turned on. Thus, currents flow in the P-type FETs 301 to 303. The current flowing in the P-type FET 303 is controlled to become a mirror current of the P-type FET 302 by a current mirror circuit, such that the drain voltage of the P-type FET 303 is substantially maintained constant, and the second reference voltage VREF2 is obtained as the output voltage of the second reference voltage generation unit 3.

Figure 5:
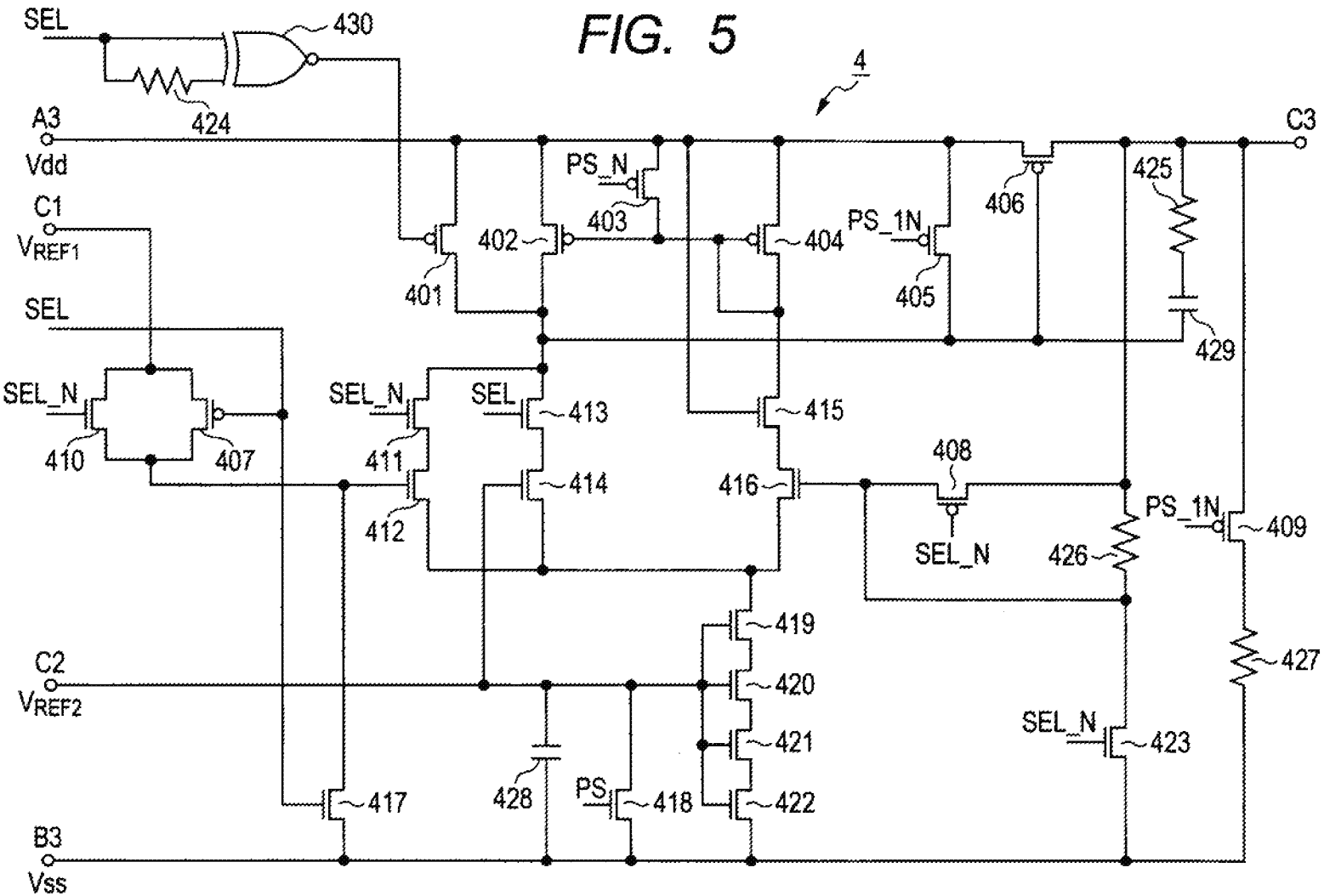
FIG. 5 is a circuit diagram showing a configuration example of a constant voltage generation unit according to this embodiment.

FIG. 5 is a circuit diagram showing a configuration example of the constant voltage generation unit 4 in the constant-voltage circuit 1. The constant voltage generation unit 4 is configured to generate a constant voltage on the basis of the output voltage of the first reference voltage generation unit 2 or the second reference voltage generation unit 3. The constant voltage generation unit 4 includes P-type FETs 401 to 409, N-type FETs 410 to 423, resistors 424 to 427, capacitors 428 and 429, and an EX-NOR circuit 430. The constant voltage generation unit 4 controls a current flowing in the P-type FET 406 to generate a substantially constant output voltage. Although in this embodiment, a voltage which is generated by the constant voltage generation unit 4 is about 1.8 V, the invention is not limited thereto.

The P-type FET 406 is connected between a terminal A3 to which the power supply voltage Vdd is applied and a terminal B3 to which the ground voltage Vss (GND). The drain of the P-type FET 406 is connected to an output terminal C3 of the constant voltage generation unit 4 such that the drain voltage becomes the output voltage of the constant voltage generation unit 4. The drain of the P-type FET 406 is connected to the terminal B3 through the P-type FET 409 and the resistor 427, such that the drain voltage of the P-type FET 406, that is, the output voltage of the output terminal C3 is controlled by a current flowing in the resistor 427.

The gate of the P-type FET 406 is connected to the drain of the P-type FET 402 connected between the terminal A3 and the terminal B3. The drain of the P-type FET 402 is connected to the N-type FET 412, which is controlled by the output voltage of the first reference voltage generation unit 2, through the N-type FET 411, and is connected to the N-type FET 414, which is controlled by the output voltage of the second reference voltage generation unit 3, through the N-type FET 413. The source of the N-type FET 412 and the source of the N-type FET 414 are connected to the terminal B3 through the N-type FETs 419 to 422 connected to the output terminal B2 of the second reference voltage generation unit 3. That is, the N-type FETs 411 and 412 and the N-type FETs 413 and 414 are connected in parallel between the terminal A3 and the terminal B3.

The gate of the N-type FET 412 is connected to the output terminal C1 of the first reference voltage generation unit 2 through the P-type FET 407 and the N-type FET 410. The gate of the N-type FET 414 is connected to the output terminal C2 of the second reference voltage generation unit 3. The inverted selection signal SEL_N is input to the gate of the N-type FET 411, and the N-type FET 411 is turned on at the timing at which the first reference voltage generation unit 2 is enabled. The selection signal SEL is input to the gate of the N-type FET 413, and the N-type FET 413 is turned on at the timing at which the first reference voltage generation unit 2 is disabled. For this reason, while the first reference voltage generation unit 2 is in operation, currents flow in the N-type FETs 411 and 412, and after the first reference voltage generation unit 2 is stopped, currents flow in the N-type FETs 413 and 414. Therefore, a voltage based on the operation situations of the first reference voltage generation unit 2 and the second reference voltage generation unit 3 is applied to the gate of the P-type FET 406, and the output voltage of the output terminal C3 is controlled.

The gate of the P-type FET 402 is connected to the gate (drain) of the P-type FET 404 connected between the terminal A3 and the terminal B3. For this reason, the drain voltage of the P-type FET 404 is applied to the gate of the P-type FET 402, and a current corresponding to a current flowing in the P-type FET 404 flows in the P-type FET 402. The drain of the P-type FET 404 is connected to the terminal B3 through the N-type FETs 415, 416, and 419 to 422.

A signal which is generated by the EX-NOR circuit 430 on the basis of the selection signal SEL is input to the gate of the P-type FET 401. The inverted power save signal PS_N is input to the gate of the P-type FET 403. A delayed inverted power save signal PS_1N obtained by delaying the inverted power save signal PS_N is input to the gates of the P-type FETs 405 and 409. The selection signal SEL is input to the gates of the P-type FET 407 and the N-type FET 417. The inverted selection signal SEL_N is input to the gates of the P-type FET 408 and the N-type FETs 410 and 423. The power save signal PS is input to the gate of the N-type FET 418.

If the power save signal PS at low level, the inverted power save signal PS_N at high level, the selection signal SEL at low level, and the inverted selection signal SEL_N at high level are input to the above-described constant voltage generation unit 4 (the activation of the constant-voltage circuit 1), the P-type FET 407 is turned on, the P-type FETs 401 to 404 and 408 are turned off, the N-type FETs 410, 411, and 423 are turned on, and the N-type FETs 413, 417, and 418 are turned off. At this time, since the delayed inverted power save signal PS_1N is at low level, the P-type FETs 405 and 409 are turned on. If the first reference voltage VREF1 rises after a predetermined time, a current flows from the terminal A3 through the P-type FET 405, and the N-type FETs 411, 412, and 419 to 422, and a predetermined level is applied to the drain of the P-type FET 405, that is, the gate of the P-type FET 406. Since the first reference voltage VREF1 is applied to the N-type FET 412, a voltage corresponding to the first reference voltage VREF1 is applied to the gate of the P-type FET 406. Thus, the voltage of the output terminal C3 starts to rise. The gate of the P-type FET 406 is connected to the output terminal C3 through the capacitor 429 and the resistor 425, and the output terminal C3 is connected to the terminal B3 through the P-type FET 409 and the resistor 427, such that the voltage of the output terminal C3 gradually rises. Thereafter, if the delayed inverted power save signal PS_1N is at high level, the P-type FETs 405 and 409 are turned off. The voltage of the output terminal C3 rises to about 1.8 V.

If the selection signal SEL is at high level, and the inverted selection signal SEL_N is at low level, the P-type FET 408 is turned on, the P-type FET 407 is turned off, the N-type FETs 413 and 417 are turned on, and the N-type FETs 410, 411, and 423 are turned off. At this time, since the N-type FET 416 is turned on, the P-type FETs 402 and 404 are also turned on. As a result, a current flows from the terminal A3 through the P-type FET 404 and the N-type FETs 415, 416, and 419 to 422. Since the second reference voltage VREF2 is applied to the N-type FET 414, a current flows from the terminal A3 through the P-type FET 402 and the N-type FETs 413, 414, and 419 to 422. Therefore, a voltage corresponding to the second reference voltage VREF2 is applied to the gate of the P-type FET 406, and the voltage of the output terminal C3 is maintained at 1.8 V.

The control unit 5 has a control signal generation unit 501 which generates control signals, such as the power save signal PS and the selection signal SEL, and a storage unit 502 which stores a correction value for correcting the output voltage of the second reference voltage generation unit 3. The storage unit 502 is not particularly limited insofar as the storage unit is a nonvolatile type in which memory can be held without power supply.

A correction value which is written to the storage unit 502 is acquired, for example, as follows. First, a reference voltage is applied from the outside to the external voltage input terminal 6. As the reference voltage, a voltage which is equal to a voltage generated when the constant-voltage circuit 1 is normally operated is used. As described in this embodiment, when the voltage generated by the constant-voltage circuit is 1.8 V, 1.8 V is used as the reference voltage. Next, the switch 7 is operated to apply the reference voltage to the control unit 5. At this time, the output voltage of the constant voltage generation unit 4 changes with the resistance value of the variable resistor 314 of the second reference voltage generation unit 3. For this reason, the output voltage of the constant voltage generation unit 4 is monitored, and the resistance value of the variable resistor 314 is changed to acquire the condition such that an appropriate output voltage is obtained. After the condition is acquired, the condition is written to the storage unit 502 as a correction value. In this way, it is possible to acquire the correction value. The output voltage of the constant voltage generation unit 4 can be confirmed by monitoring the voltage of the monitor pin 8.

Hereinafter, the operation of the above-described constant-voltage circuit 1 will be described.

Figure 6:
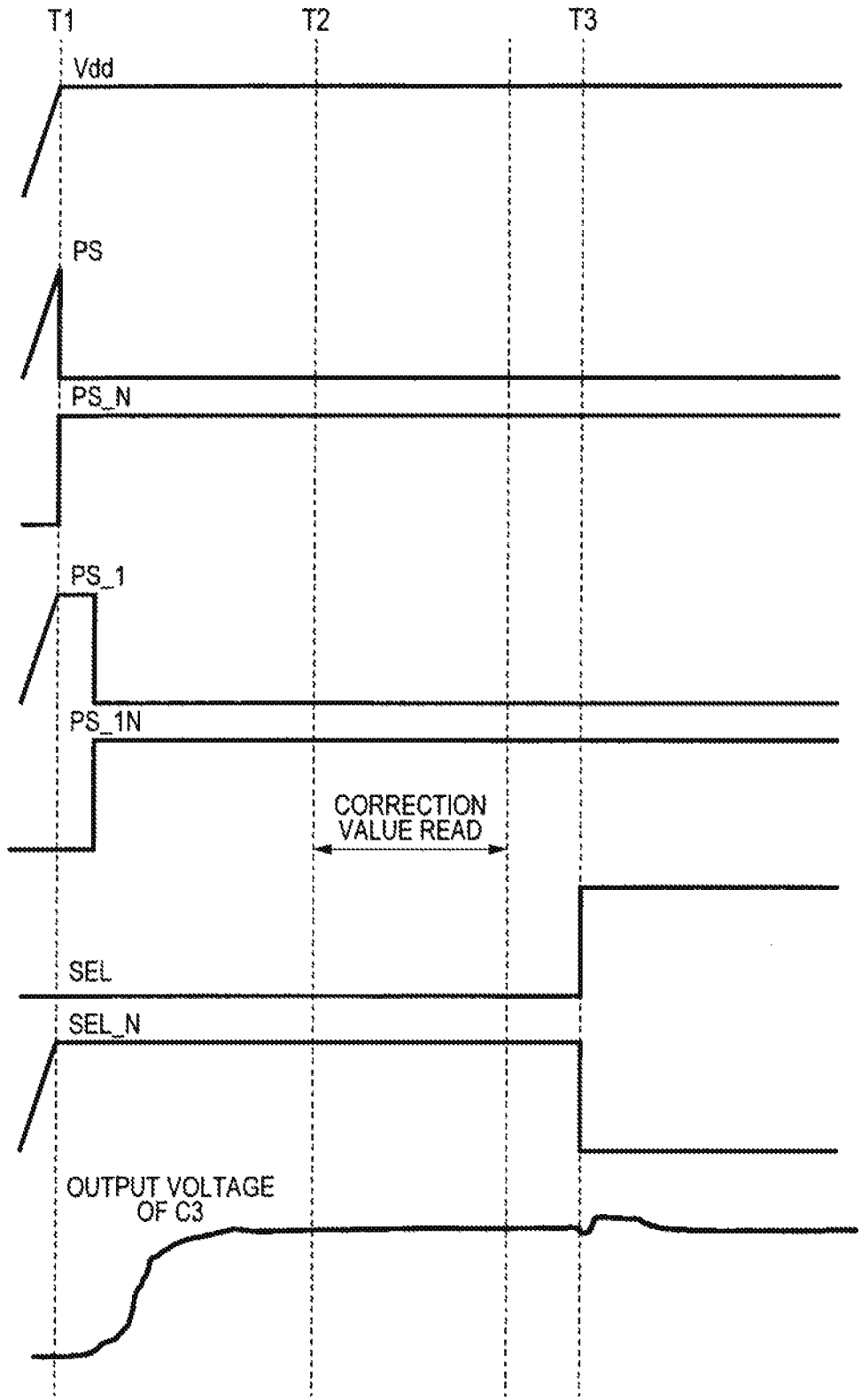
FIG. 6 is a timing chart of the constant-voltage circuit according to this embodiment.

FIG. 6 is a timing chart showing the operation timing of the constant-voltage circuit 1 of this embodiment. First, if the constant-voltage circuit 1 is activated, the power supply voltage Vdd rises and the signal level of the control signal rises starting with the power save signal PS. Simultaneously, the output voltage of the first reference voltage generation unit 2 starts to rise. If the power supply voltage Vdd reaches a predetermined level, the power save signal PS is at low level, the inverted power save signal PS_N is at high level, the selection signal SEL is at low level, and the inverted selection signal SEL_N is at high level (timing T1). The output voltage of the first reference voltage generation unit 2 rises to the first reference voltage VREF1, and the output voltage of the constant voltage generation unit 4 becomes about 1.8 V. The first reference voltage generation unit 2 is a so-called bandgap reference voltage generation circuit, and the output voltage thereof is stable even immediately after activation, thereby realizing stable activation of the constant-voltage circuit 1.

At the timing (timing T2) at which the output voltage of the constant voltage generation unit 4 is stable, the control unit 5 reads the correction value stored in the storage unit 502 and provides the correction value to the second reference voltage generation unit 3. Thus, the resistance value of the variable resistor 314 of the second reference voltage generation unit 3 has a value corresponding to the read correction value.

Thereafter, at the timing (timing T3) at which the correction of the resistance value of the variable resistor 314 is completed, the selection signal SEL is at high level, and the inverted selection signal SEL_N is at low level. As a result, the first reference voltage generation unit 2 is disabled and stopped. The second reference voltage generation unit 3 continues to be operated, and the constant voltage generation unit 4 generates 1.8 V on the basis of the second reference voltage VREF2 from the second reference voltage generation unit 3. The second reference voltage generation unit 3 uses a field effect transistor having low power consumption, thereby suppressing power consumption of the constant-voltage circuit 1.

As described above, in the constant-voltage circuit 1 of this embodiment, the constant-voltage circuit 1 is launched by the first reference voltage generation unit 2 which uses a bipolar transistor having excellent activation performance with constant voltage in the vicinity of 1.2 V, and thereafter, the first reference voltage generation unit 2 is stopped, thereby generating a constant voltage by the second reference voltage generation unit 3 which uses a field effect transistor having low power consumption. For this reason, the constant-voltage circuit 1 which achieves both stable activation and low power consumption is realized. Since the resistance value of the variable resistor 314 is corrected to the correction value to reduce the influence of a process variation in the second reference voltage generation unit 3, it is not necessary to use a method which causes an increase in cost, such as laser trimming or fuse trimming Therefore, it is possible to suppress a manufacturing cost of the constant-voltage circuit 1.

The invention is not limited to the description of the foregoing embodiment, and may be appropriately changed in a mode capable of exhibiting the effects of the invention. For example, other circuit elements may be included in the constant-voltage circuit 1 of the invention within a scope which does not affect the operation. Similarly, circuit elements may not be provided within a scope which does not affect the operation. Impedance, capacitance, or the like of each constituent element may be appropriately changed in accordance with a voltage to be generated, transistor characteristics, or the like.

The constant-voltage circuit according to the embodiment of the invention is useful as a constant-voltage source which generates a voltage necessary for the operation of a digital circuit.

What is claimed is:

1. A constant-voltage circuit comprising:

a first reference voltage generation unit configured to generate a first reference voltage using a bandgap voltage of a bipolar transistor;

a second reference voltage generation unit configured to generate a second reference voltage using a field effect transistor;

a constant voltage generation unit coupled to the first and second reference voltage generation units, configured to generate a constant voltage based on either one of the first reference voltage or the second reference voltage; and a control unit configured to control the first reference voltage generation unit, the second reference voltage generation unit, and the constant voltage generation unit, the control unit having a storage unit which stores a correction value for the second reference voltage generation unit, wherein the control unit allows, during an initial activation period, the first reference voltage generation unit and the second reference voltage generation unit to operate, and then turns off the first reference voltage generation unit during an operation period after the initial activation period, wherein, during the initial activation period, the control unit, powered by the output voltage of the constant voltage generation unit generated using the first reference voltage reads the correction value stored in the storage unit and corrects the second reference voltage, and wherein, during the operation period, the constant voltage generation unit generates the output voltage using the second reference voltage.

2. The constant-voltage circuit according to claim 1, further comprising:

an external voltage input terminal configured to receive an external reference voltage;

a switch configured to selectively apply one of the output voltage of the constant voltage generation unit and the external reference voltage to the control unit; and a monitor pin configured to monitor the output voltage of the constant voltage generation unit, wherein the correction value is determined such that the output voltage of the constant voltage generation unit has a predetermined value when the external reference voltage is applied to the control unit.

3. The constant-voltage circuit according to claim 1, wherein the storage unit is rewritable.

4. The constant-voltage circuit according to claim 1, wherein the second reference voltage generation unit includes two field effect transistors which are diode-connected, and wherein the influence of a fluctuation in the characteristic of one field effect transistor due to a change in temperature is balanceable by another field effect transistor.

5. The constant-voltage circuit according to claim 1, wherein the second reference voltage generation unit include:

two field effect transistors whose gates are connected together, a first capacitor a first end of which is connected to the gates, and a second capacitor a first end of which is connected to a second end of the first capacitor, and wherein a predetermined voltage is applied to a second end of the second capacitor such that a rapid fluctuation in the voltage of the gates is suppressed.

6. The constant-voltage circuit according to claim 1, wherein the constant voltage generation unit generates the constant voltage based on the first reference voltage during the initial activation period, and based on the second reference voltage during the operation period after the initial activation period.

7. The constant-voltage circuit according to claim 1, wherein the second reference voltage generation unit includes a variable resistance, the control unit adjusting the variable resistance during the initial activation period using an external reference voltage such that the output voltage of the constant voltage generation unit has a predetermined value.

8. The constant-voltage circuit according to claim 1, wherein the control unit is configured to generate a power signal to turn on the first and second reference voltage generation units, and to generate a selection signal to turn off the first reference voltage generation unit.

* * * * *